US008939159B2

(12) United States Patent
Yeo et al.

(10) Patent No.: US 8,939,159 B2
(45) Date of Patent: Jan. 27, 2015

(54) EYELINER APPLICATION AID

(71) Applicant: Sultria Cosmetics Inc., Richmond (CA)

(72) Inventors: Yasiv Martin Rafaela Yeo, Richmond (CA); Marilyn Jean Yeo, Richmond (CA); Ivania Maria Marin Morales, Burnaby (CA)

(73) Assignee: Sultria Cosmetics Inc., Richmond (CA)

( * ) Notice: Subject to any disclaimer, the term of this patent is extended or adjusted under 35 U.S.C. 154(b) by 0 days.

(21) Appl. No.: 13/871,614

(22) Filed: Apr. 26, 2013

(65) Prior Publication Data

US 2013/0284197 A1 Oct. 31, 2013

Related U.S. Application Data

(60) Provisional application No. 61/639,134, filed on Apr. 27, 2012.

(51) Int. Cl.
*A45D 40/30* (2006.01)

(52) U.S. Cl.
CPC ..... *A45D 40/30* (2013.01); *A45D 2200/1072* (2013.01)
USPC ..... 132/216

(58) Field of Classification Search
USPC ..... 132/216, 214, 217, 218, 318, 320; D28/36
See application file for complete search history.

(56) References Cited

U.S. PATENT DOCUMENTS

| | | | | | |
|---|---|---|---|---|---|
| 3,343,552 | A * | 9/1967 | Steffen | ..... | 132/320 |
| 3,485,251 | A | 12/1969 | Brunet | | |
| 5,186,190 | A | 2/1993 | Hirzel | | |
| 6,050,273 | A * | 4/2000 | Lhuisset | ..... | 132/317 |
| D533,302 | S | 12/2006 | Luciano | | |
| 8,141,564 | B2 | 3/2012 | Cassese | | |
| 8,235,060 | B2 | 8/2012 | Konrad | | |
| 2004/0255971 | A1 * | 12/2004 | Houghton | ..... | 132/319 |
| 2008/0283083 | A1 * | 11/2008 | Piao | ..... | 132/317 |

* cited by examiner

*Primary Examiner* — Rachel Steitz
(74) *Attorney, Agent, or Firm* — Oyen Wiggs Green & Mutala LLP; Christopher C. Scott

(57) ABSTRACT

This invention comprises apparatus for assisting in the application of eyeliner. A handle connects to a shaped member, such as a metal rod, which comprises a guide portion for abutting against a user's eyelid. Users may apply eyeliner by drawing an eyeliner applicator along a side of the guide portion. The guide portion may optionally end in a wing, allowing users to draw eyeliner "wings". A nose bridge may be situated between the guide portion and the handle, allowing the apparatus to be positioned across a user's nose. The handle may comprise a smudger with which a user may smudge eyeliner after it has been applied.

18 Claims, 4 Drawing Sheets

EYELINER APPLICATION AID

RELATED APPLICATIONS

This application claims priority to U.S. Provisional Application No. 61/639,134, filed 27 Apr. 2012. This application claims the benefit under 35 U.S.C. §119 of U.S. Provisional Application No. 61/639,134, filed 27 Apr. 2012, which is hereby incorporated by reference in its entirety.

TECHNICAL FIELD

This invention relates to aids for applying cosmetics. Such aids may, for example, be used by persons to improve the accuracy with which eyeliner is applied around an eye.

BACKGROUND

Many people apply eyeliner or other cosmetics around their own eyes or around the eyes of others. Eyeliner is typically applied in lines that trace the upper and/or lower edges of the eyelid (the "eyelines"). It may generally be desirable to apply eyeliner symmetrically to each eyelid and in smooth lines. Applying eyeliner accurately or in a manner which yields an attractive result is a learned skill that often requires a steady hand and significant practice.

Many people lack this skill. As a consequence, some people avoid wearing eyeliner, or avoid applying it themselves. Some people spend additional time and effort reapplying eyeliner after initial applications result in misshapen or uneven lines. Some people pay professional makeup artists to apply cosmetics for them, particularly for special occasions. Some people save time and effort by accepting undesirable applications as "good enough".

Several types of eyeliner are known in the art; these include powder-based eyeliner (often applied with a pencil-like applicator), wax-based eyeliner, gel eyeliner, liquid eyeliner, and kohl eyeliner. Liquid and kohl eyeliner are often desirable eyeliners for their striking appearance, but are also particularly difficult to apply accurately, in part due to their propensity for accidental smudges during application.

Eyeliner application aids are sometimes used to help apply eyeliner. Some eyeliner application aids comprise adhesive guide strips to be applied to a part of the eyelid just above the upper eyeline. Stray eyeliner is removed when the adhesive guide is removed. Such an eyeliner application aid can be seen in U.S. Pat. No. 3,485,251 to Brunet et al.

Another eyeliner application aid comprises an arcuate surface connected to a handle. The handle is held in a vertical position beneath an eye, allowing the user to apply makeup to a person's lower eyelash rims. As such a device requires the user to hold the handle above or below the eye, the user may have to adopt an uncomfortable position while holding the device and/or hold the device in a dominant hand while applying eyeliner to one of the eyes with the non-dominant hand. Since applying eyeliner is a delicate task, it is often desirable to apply eyeliner with a user's dominant hand. Such an eyeliner application aid can be seen in U.S. Pat. No. 8,141,564 to Cassese.

There is a general desire for apparatus to assist in the application of eyeliner, and in particular for apparatus that enable users to apply eyeliner accurately with reduced training and effort. There also remains a desire for a device that ameliorates at least some of the deficiencies in the above-described apparatus.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

This invention has several aspects. One aspect of the invention provides an eyeliner application aid. The eyeliner application aid includes a handle connected to a shaped member. The shaped member includes a curved guide portion shaped to be pressed against a person's eyelid. In some embodiments, the guide portion is shaped to press a cushion against a person's eyelid. Some aspects provide methods by which users may apply eyeliner by drawing an eyeliner applicator along an edge of the guide portion. Various aspects of the invention provide one or more of: a wing extension of the guide portion for drawing eyeliner wings, a nose bridge for receiving a person's nose, a smudger for smudging cosmetics after application to a person's face, and extension portions of the shaped member between the curved guide portion and the handle.

An aspect of the invention provides a handle extending in an extension direction and a shaped member connected to the handle. The shaped member also extends generally in the extension direction. The shaped member comprises a guide portion adapted to receive an eyelid of the person and protruding in a protrusion direction. The protrusion direction is orthogonal to the extension direction. The shaped member also includes a nose bridge portion between the guide portion and the handle. The nose bridge portion is adapted to receive at least a portion of a nose bridge of the person and protruding in the protrusion direction.

In some embodiments of the invention the guide portion and the nose bridge portion are spaced apart in the extension direction at a distance corresponding to a distance between the nose bridge and the eyelid of the person. In some such embodiments, the distance between an apex of the guide portion and an apex of the nose bridge portion in the extension direction is between 25 millimetres and 51 millimetres.

Some embodiments of the invention provide a cushion abutting and connected to a concave surface of the guide portion, the cushion comprising a compressible material. Some embodiments of the invention provide a smudger connected to the handle and comprising a compressible material adapted to smudge a cosmetic on a user's skin.

In some embodiments of the invention, the shaped member comprises a wing portion. The wing portion is connected to the guide portion and extends at least partially in the extension direction. The wing portion is adapted to abut a portion of a user's face proximate to the user's eye.

In some embodiments of the invention, the handle comprises a cylinder with a diameter of at least 5 millimetres and no more than 51 millimetres along a substantial length of the handle; and the handle comprises a length of at least 50 millimetres and no more than 152 millimetres. An end of the handle distal to the shaped member may tapered in certain embodiments. In some embodiments, the handle comprises a slot and the shaped member is insertable into the slot. The slot may pass through a tapered end of the handle.

An aspect of the invention provides an extension portion connecting to the handle at a first end of the extension portion the nose bridge portion at a second end. The nose bridge portion extends in the extension direction. In some embodiments, the extension portion has a length of at least 5 millimetres and no more than 76 millimetres.

In some embodiments of the invention, at least a portion of the handle extends along an extension axis. The extension portion extends along the extension axis, and an apex of the nose bridge portion is offset from the extension axis by a distance of between 12 millimetres and 51 millimetres.

In some embodiments of the invention, the guide portion is shaped in an arc with a radius of curvature of at least 15 millimetres and no more than 31 millimetres.

In some embodiments of the invention, the shaped member has a cross-section in a plane orthogonal to the extension direction and the cross-section is generally rectangular in shape.

An aspect of the invention provides a method of applying eyeliner to a face of a person. The method includes placing a guide portion of an eyeliner application aid proximate to a first eyeline of the person, receiving with a nose bridge portion of the eyeliner application aid at least a portion of a nose of the person, and applying cosmetic material to the first eyeline by drawing an eyeliner applicator along at least a portion of a side of the guide portion.

In some embodiments of the invention, placing the guide portion of the eyeliner application aid proximate to the first eyeline involves receiving with the guide portion at least a portion of an eyelid of the person proximate to an upper or lower eyeline of the person.

Some embodiments of the invention involve placing a wing portion of the eyeliner application aid proximate to an eye of the user and applying a cosmetic material to at least a portion of the face of the person proximate to the wing portion by drawing the eyeliner applicator along at least a portion of a side of the wing portion.

Some embodiments of the invention involve gripping a handle of the eyeliner application aid with a hand while applying cosmetic material to the first eyeline proximate to a first eye of the person. The guide portion of the eyeliner application aid is placed proximate to a second eyeline of the person. The second eyeline is proximate to a second eye of the person. Cosmetic material is applied to the second eyeline by drawing the eyeliner applicator along at least a portion of a side of the guide portion. The handle of the eyeliner application aid is gripped with the hand while applying cosmetic material to the second eyeline.

An aspect of the invention provides an eyeliner application aid providing a handle extending in an extension direction and a shaped member connected to the handle. The shaped member extends generally in the extension direction and includes a guide portion adapted to receive an eyelid of the person proximate to an eyeline of the person. The guide portion comprises a curved edge along which an eyeliner applicator may be drawn, a first end, and a second end. The shaped member is adapted to place the first end proximately to a nose bridge of a person and the second end proximately to an outer corner of an eye of a person. The curved portion and the handle extend generally along a direction that extends along a length of a person's eyeline, and the guide portion protrudes in a protrusion direction. The protrusion direction is orthogonal to the extension direction.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

Figure 1A:
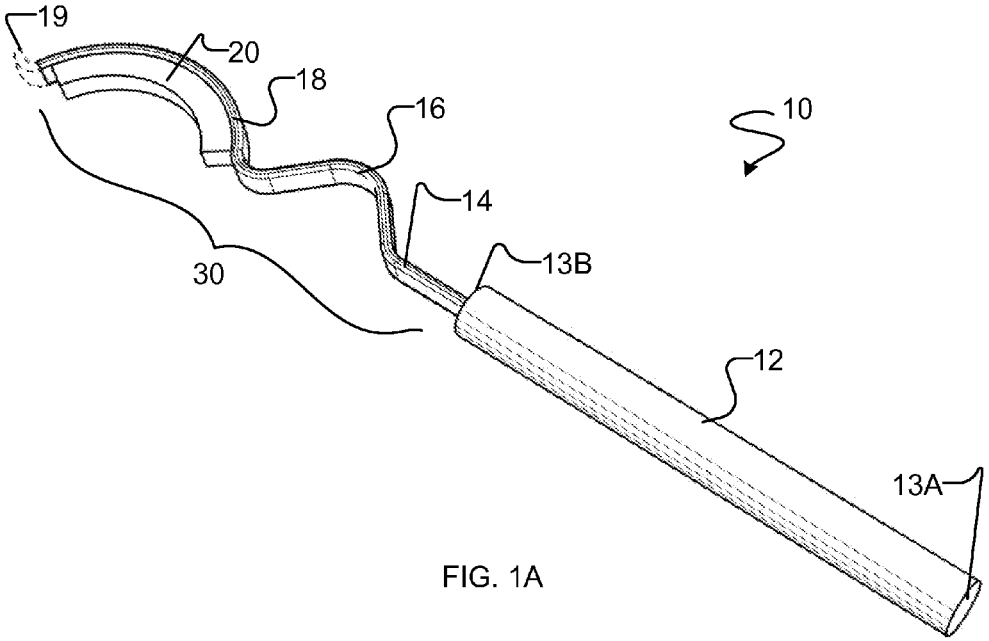
FIG. 1A is a first isometric view of an eyeliner application aid according to an example embodiment.
Figure 1B:
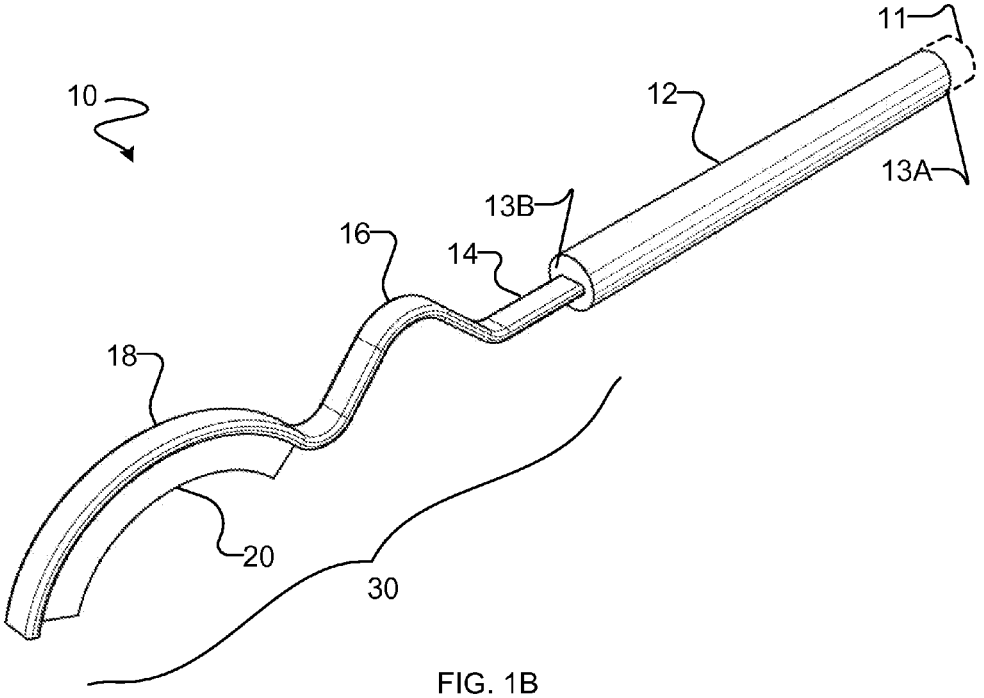
FIG. 1B is a second isometric view of the FIG. 1A eyeliner application aid.

In the drawings, some optional features are illustrated by way of dashed lines.

Description

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

This disclosure pertains to apparatus and methods for assisting in the application of eyeliner. Apparatus according to some embodiments comprise a handle connected to a shaped member. The shaped member comprises a curved guide portion shaped to be pressed against a person's eyelid and/or to press a cushion against a person's eyelid. The guide portion may abut such a cushion, with the cushion providing comfort and/or safety to the person. Users may then apply eyeliner by drawing an eyeliner applicator along an edge of the guide portion. The guide portion may be shaped in a manner generally corresponding to the curvature of a human eye. The guide portion may end in a wing extension, allowing users to draw eyeliner "wings" by drawing an eyeliner applicator along a side of a wing extension. Some embodiments of this invention comprise a nose bridge situated between the guide portion and the handle, allowing the handle to be positioned on either side of a person's face without being obstructed by the person's nose. In some embodiments, the handle comprises a smudger with which a user may smudge eyeliner after it has been applied.

FIGS. 1A, 1B, 1C and 1D (collectively, FIG. 1) show an example eyeliner application aid 10. Eyeliner application aid 10 includes a handle 12 connected to a shaped member 30. In the illustrated embodiment, shaped member 30 includes an extender 14, a nose bridge 16, a curved eyeliner guide 18, and an optional wing 19 (shown in FIG. 1A). Handle 12 is configured to be gripped by a user. In some embodiments, handle 12 has an ergonomic shape configured to conform to a user's hand.

Figure 3:
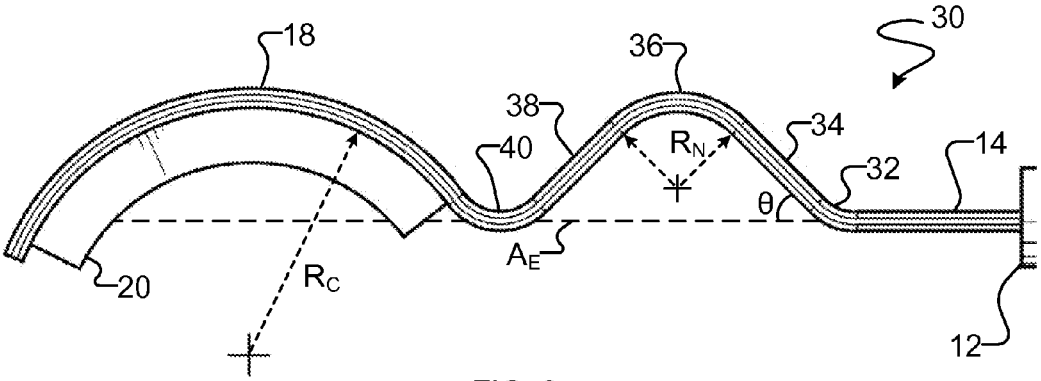
FIG. 3 is a side elevation view of a shaped member of the FIG. 1A-D eyeliner application aid.

Shaped member 20 includes an eyelinder guide 18 at an end opposite to handle 12. Eyeliner guide 18 is configured to fit over an eyelid and/or over the skin adjacent to a person's lower eyeline. In some embodiments, as best seen in FIG. 3, eyeliner guide 18 is shaped as an arc having a single radius of curvature $R_C$ (e.g. the arc of eyeliner guide 18 may trace out a portion of the circumference of a circle). Alternatively, or in addition, eyeliner guide 18 may trace out a portion of an oval, ellipse, and/or other curved shapes generally corresponding to the shape of an eyelid.

In some embodiments, radius of curvature $R_C$ is in a range of 0.6 inches to 1.2 inches so that the curvature of eyeliner guide 18 approximates generally that of an eyelid. Radius of curvature $R_C$ may be larger than that of an eyelid to account for cushion 20. In certain embodiments, the radius of curvature $R_C$ of eyeliner guide 18 is approximately 22.2 mm (approximately 0.875 inches); the inventors have found that this radius compares favorably to that of at least some persons' eyelids.

Shaped member 30 may comprise additional elements, such as nose bridge 16, extender 14, and/or wing 19. To fully describe these elements, this disclosure will first turn to describing attributes of shaped member 30 in greater detail.

Figure 1C:
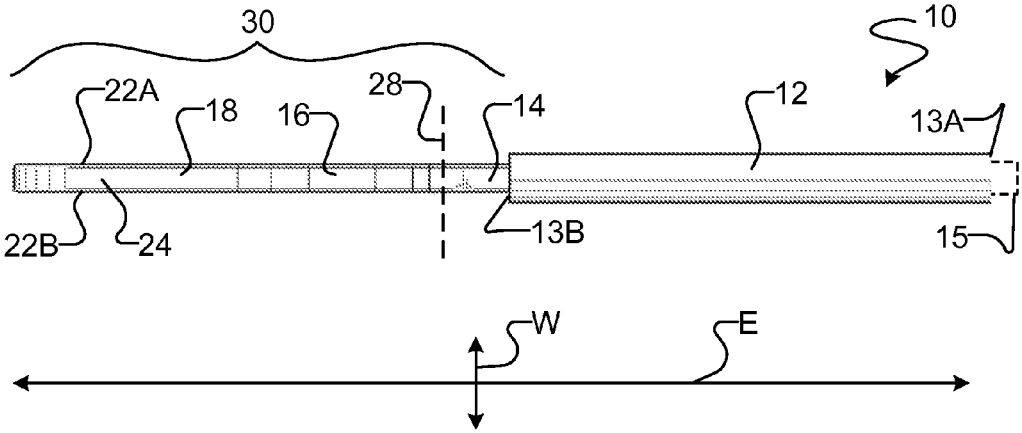
FIG. 1C is a top plan view of the FIG. 1A eyeliner application aid.
Figure 1D:
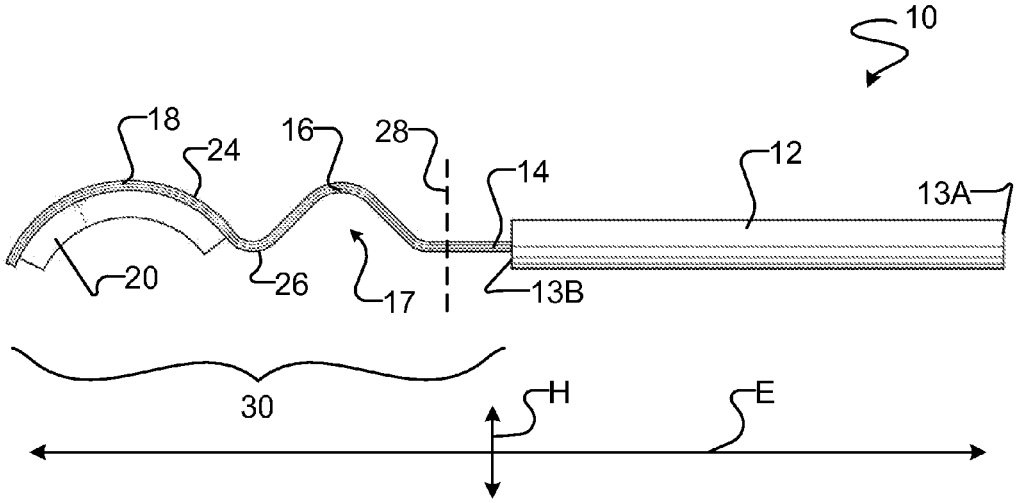
FIG. 1D is a side elevation view of the FIG. 1A eyeliner application aid.
Figure 2:
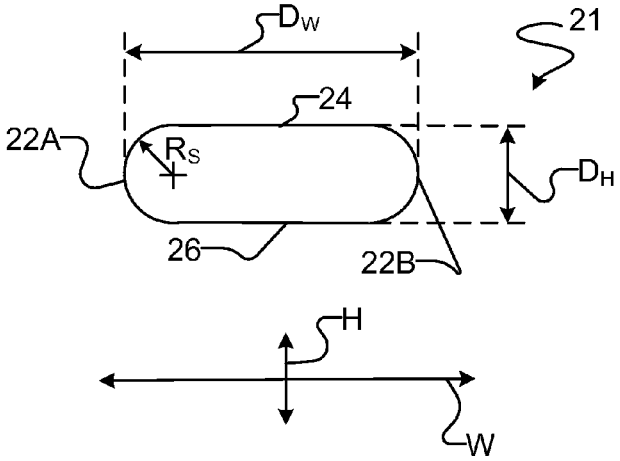
FIG. 2 is a cross-sectional view of a shaped member of the FIG. 1A-D eyeliner application aid.

FIG. 2 shows a cross-section 21 of an example shaped member 30 in a plane 28. Plane 28, shown in FIGS. 1C and 1D, is orthogonal to an extension direction E (shown in FIG. 1D) in which shaped member 30 extends. Cross-section 21 may be generally rectangular in shape. In some embodiments (and, in particular, in the illustrated embodiment), shaped member 30 has opposing sides 22A and 22B (collectively, sides 22), and a top surface 24 and a bottom surface 26 extending between sides 22. The terms "top" and "bottom" as used herein do not indicate any particular direction, but rather are simply used to refer to particular surfaces of an example shaped member 30. Eyeliner application aid 10 is intended to be used in a variety of orientations, and it is expected that top surface 24 and bottom surface 26 will, at various times, be oriented in different planes and/or oriented in different directions.

In some embodiments, at least one of sides 22 has a smooth surface (e.g. lacking in sharp angles or deviations along the length of eyeliner guide 18) along at least a portion of the length of eyeliner guide 18; such sides 22 may enable users to draw a smooth line with an eyeliner applicator by pressing the eyeliner applicator against a side 22 of eyeliner guide 18 while eyeliner guide 18 is pressed against an eyelid (or the area below an eye) adjacent to a person's eyeline. In some embodiments, one or more sides 22 of eyeliner guide 18 have patterns, shapes, and/or irregularities on the surface of sides 22, causing an eyeliner applicator drawn along such a side 22 to trace out a corresponding design in the area of the eyeliner. For example, one or more sides 22 of eyeliner guide 18 may comprise a series of sharp indentations in a pattern reminiscent of a flame, allowing a user of eyeliner application aid 10 to easily trace out a flame-like pattern in eyeliner. Other such designs may be incorporated into the sides 22 of eyeliner guide 18.

In at least some embodiments, cross-section 21 has rounded and/or curved sides 22 for persons' comfort and/or safety. Thus cross-section 21 may have a rounded rectangular shape as seen in FIG. 2. In the illustrated embodiment, the sides of shaped member 30 are semi-circles when viewed in cross-section 21, with convex surfaces facing outwards. In the illustrated embodiment, as best seen in FIG. 2, sides 22 have a radius of curvature $R_S$ that is approximately one-half the height $D_H$ of shaped member 30; for example, if the height $D_H$ of shaped member 30 is approximately 1.59 mm (approximately 0.0625 inches), the radius of curvature may be approximately 0.794 mm (approximately 0.03125 inches). The sides 22 of shaped member 30 may take other shapes; for example, they may appear to be partial ovals, ellipses, and/or polygons when viewed in cross-section 21.

In some embodiments, shaped member 30 is slightly flexible in a first transverse direction H which is orthogonal to extension direction E and in plane 28. In use, first transverse direction H is generally perpendicular to the surface of an eyelid. In addition, or in the alternative, shaped member 30 may be relatively inflexible in the second transverse direction W, which is orthogonal to both extension direction E and first transverse direction H (see FIGS. 1C and 2). In use, second transverse direction W is the direction in which an eyeliner applicator (such as a pencil-like or brush eyeliner application) will abut and/or apply force to the shaped member 30 while being drawn across a side 22 of shaped member 30. In illustrative terms, eyeliner guide 18 may be flexed "backwards" when pressed against an eyelid, and/or it may be less flexible in a "sideways" direction when an eyeliner applicator is drawn along a side 22.

In some embodiments, shaped member 30 has a width $D_W$ (e.g., measured between sides 22 in second transverse direction W, as seen in FIG. 2) that is between two and four times larger than its height $D_H$ (e.g., measured between top surface 24 and bottom surface 26 in first transverse direction H). For example, in one embodiment, shaped member 30 has a width $D_W$ of approximately 4.76 mm (approximately 0.1875 inches) and a height $D_H$ of approximately 1.59 mm (approximately 0.0625 inches). In such an example embodiment, the width $D_W$ of shaped member 30 is three times its height $D_H$, and may allow for some flexibility in movement when force is applied to shaped member 30 in first transverse direction H and relatively less flexibility in movement when force is applied to shaped member 30 in second transverse direction W.

A cushion 20 may abut eyeliner guide 18 such that, when eyeliner guide 18 is positioned against a person's eyelid, cushion 20 presses against and conforms to a shape of the eyelid and holds eyeliner guide 18 away from the eyelid. This may improve the comfort and/or safety of the person by preventing and/or reducing the likelihood of eyeliner guide 18 being accidentally inserted into the eye or surrounding sensitive areas. Cushion 20 may comprise any suitably soft and/or pliant material. For example, cushion 20 may comprise foam, rubber, and/or silicone. Cushion 20 may be a wipeable and/or non-porous material to enable convenient and sanitary cleaning by a user. In at least one embodiment, cushion 20 comprises Evazote closed foam.

Cushion 20 may be shaped to conform to the curvature of an eye and/or shield the eye from eyeliner guide 18. In some embodiments, cushion 20 abuts a concave surface of eyeliner guide 18. In the illustrated embodiment, cushion 20 abuts bottom surface 26 of eyeliner guide 18. In the illustrated embodiment, cushion 20 runs substantially the entire length of eyeliner guide 18. Cushion 20 may be affixed to eyeliner guide 18 with an adhesive, and/or may be removably connected to eyeliner guide 18. For example, cushion 20 may comprise a sleeve that fits around a portion of eyeliner guide 20, eyeliner guide 18 may comprise a slot that receives a portion of cushion 20 (for example, a rigid backing of cushion 20 may slide into the slot and remain in place until a user slides it out of the slot), and/or eyeliner guide 18 and cushion 18 may connect via other means of connection that are known in the art.

Shaped member 30 may include a nose bridge 16 connected to and extending between eyeliner guide 18 and extender 14 (or between eyeliner guide 18 and handle 12). Nose bridge 16 is shaped to receive at least a portion of a person's nose. In the illustrated embodiment, nose bridge 16 corresponds generally to a shape of a bridge of a typical person's nose. In the illustrated embodiment, as best seen in FIG. 1D, nose bridge 16 extends in first transverse direction H, leaving a triangular area 17 into which a person's nose may be received. In some embodiments, nose bridge 16 may have a semicircular, polygonal (e.g. trapezoidal, square, partial hexagon, or other polygonal shape), irregular, and/or other area 17 into which a person's nose may be at least partially received. As depicted in the illustrated embodiment, nose bridge 16 may have rounded "corners" (corresponding to first junction 32, second junction 36 and third junction 40 in FIG. 3); in other embodiments, corners of nose bridge 16 may instead, or in addition, be at sharp angles and/or be smoothed in other manners.

In at least one embodiment, nose bridge 16 reaches an apex (i.e. a furthest point from axis $A_E$, shown in FIG. 3) at a distance in a range of approximately 12.7 mm (approximately 0.5 inches) to approximately 50.8 mm (approximately 2 inches) from axis $A_E$. A nose inserted into the area 17 outlined by such a nose bridge 16 could be inserted at most 12.7 mm to 50.8 mm deep. In other embodiments, nose bridge 16 reaches an apex at a greater or lesser distance. The distance of the apex from axis $A_E$ may depend on factors such as, for example, the size of nose that an embodiment is directed towards and/or the size of the cushion 20 used in an embodiment. In some embodiments, nose bridge 16 has an apex approximately 25.4 mm (approximately 1 inch) away from axis $A_E$. In the illustrated embodiment, the apex of nose bridge 16 coincides with second junction 36 (depicted in FIG. 3).

Nose bridge 16 and eyeliner guide 18 may be configured such that nose bridge 16 can fit over a nose and eyeliner guide 18 can fit over an eyelid (or otherwise around an eye) simultaneously during operation of eyeliner application aid 10. In some embodiments, the apex of eyeliner guide 18 is spaced between one and two inches away from the apex of nose bridge 16 in extension direction E. The apexes of eyeliner guide 18 and nose bridge 16 may be the same or different distances from axis $A_E$. In at least one embodiment, the distance between the apexes in extension direction E is approximately 38.1 mm (approximately 1.5 inches).

In the illustrated embodiment, shaped member 30 includes an extender 14 that extends from handle 12 and connects to nose bridge 16. Nose bridge 16 is optional and, in some embodiments, nose bridge 16 is omitted and extender 14 connects directly to eyeliner guide 18. In the illustrated embodiment, extender 14 extends along the rotational axis of handle 12 (axis $A_E$, depicted in FIG. 3) and connects to proximate handle end 13B. Extender 14 may be any suitable length. In some embodiments the length of extender 14 is in a range of approximately 5.1 mm (approximately 0.2 inches) to approximately 76.2 mm (approximately 3 inches). For example, in an embodiment where extender 14 is inserted into a slot in handle 12 with a depth of 19.1 mm (approximately 0.75 inches), extender 14 may be approximately 34.9 mm (approximately 1.375 inches) in length, thereby exposing approximately 15.8 mm (approximately 0.625 inches) of extender 14.

In some embodiments, as seen in FIG. 1A, for example, shaped member 30 includes a wing 19. Wing 19 may extend from eyeliner guide 18 at an end of eyeliner guide 18 that is furthest from handle 12. Wing 19 enables a user to continue tracing eyeliner beyond eyeliner guide 18 and therefore beyond the eyeline and onto a portion of a person's skin adjacent to the person's eye. This effect is popular in some styles of eyeliner application. Wing 19 may comprise a curve, straight line, or other shape, according to the effect desired. In the illustrated embodiment, wing 19 (shown in dashed lines) extends from a tip of eyeliner guide 18. In some embodiments, wing 19 is a permanently-connected portion of shaped member 30. In other embodiments, wing 19 is removable.

In some embodiments, at least a portion of wing 19 is composed of a semi-rigid material and can be elastically deformed to provide the desired curvature and shape for tracing eyeliner around the eye or extending away from the eye.

Shaped member 30 extends from handle 12. Handle 12 may comprise materials that are the same as or different than all or part of shaped member 30. For example, handle 12 and shaped member 30 may both comprise plastic and/or stainless steel. In some embodiments, handle 12 and shaped member 30 are integrally formed. In other embodiments, shaped member 30 and handle 12 may be distinct elements, which may themselves comprise multiple pieces.

In some embodiments, a portion of shaped member 30 may be adapted to be received and held inside handle 12. Handle 12 may, for example, be molded around a portion of shaped member 30. Alternatively, or in addition, handle 12 may comprise a slot for receiving shaped member 30. In such an embodiment, the shaped member may be held in place by friction, elastic deformation forces, and/or with pegs inserted through apertures in the shaped member. In some embodiments, handle 12 is assembled by pressing multiple components together. In particular embodiments wherein handle 12 comprises a cylinder with an end detail 15 on handle end 13B (described further below), handle 12 may comprise a slot with an aperture on a face of the end detail 15. The slot is configured to receive the shaped member and hold the shaped member in place during use of eyeliner application aid 10. In at least one embodiment, handle 12 is 3.5 inches in length and the slot is 0.75 inches in length.

In some embodiments, shaped member 30 may be retractable into handle 12 and/or foldable with handle 12. For example, shaped member 30 may meet handle 12 at a hinge element. The hinge element may lock in shaped member in an extended position (where shaped member 30 extends away from handle 12 in extension direction E) and in a folded position (where shaped member 30 runs substantially adjacent to and/or is received by handle 12 in extension direction E). For example, the hinge element may allow shaped member 30 to pivot approximately 180 degrees such that eyeliner guide 18 and/or cushion 20 abut handle 12 at a point near to handle end 13A.

Handle 12 may extend in substantially the same direction as shaped member 30, allowing eyeliner application aid 10 to be held at one side of a person's face during application. Alternatively, or in addition, handle 12 or a portion thereof may extend in a different direction. For example, a portion of handle 12 may extend at a 90 degree angle to the direction in which the shaped member substantially extends (e.g. forming an L-shape). Different portions of handle 12 may extend in different directions; for example, handle 12 may comprise an arcuate shape.

Handle 12 may be made from one or more suitable materials. By way of non-limiting example, such materials may include plastic (such as ABS resin and/or polycarbonate polymers), metal (such as chrome, stainless steel, aluminum, and/or other metals), rubber, silicone, and/or organic materials such as bamboo and/or wood (e.g. recycled wood fibers). These and/or other materials may be used in handle 12 and/or shaped member 30, as will be apparent to one skilled in the art. Handle 12 may be made from multiple materials; for example, handle 12 may have a core made from one material surrounded by an outer layer made from a different material. Handle 12 may be coloured with one or more colours, and designs may be imprinted, embossed, engraved, pigmented or otherwise made visible on handle 12.

All or one or more portions of handle 12 may be hollow and/or solid. Handle 12 may be weighted to counterbalance the weight of the shaped member. Handle 12 may, for example, comprise a single molded shape, multiple pressed and/or connected pieces, an extruded shape (e.g. an extruded aluminum shape), a stamped shape (e.g. stamped metal or plastic), and/or a combination thereof. In particular embodiments, handle 12 may comprise a cylinder. The cylinder may have a diameter in the range of approximately 5.1 mm (approximately 0.2 inches) to approximately 51 mm (approximately 2 inches), for example. In certain embodiments, the cylinder has a diameter of approximately 9.5 mm (approximately 0.375 inches).

In the illustrated embodiment, handle 12 comprises a cylinder with two ends—a handle end 13B located proximate to shaped member 30 and a handle end 13A located distally from shaped member 30. In the illustrated embodiment, shaped member 30 extends from proximate handle end 13B. Distal handle end 13A may, in some embodiments, comprise a smudger 11. An optional smudger 11 is shown in dashed lines in FIG. 1B. Smudger 11 may be used to smudge eyeliner or other cosmetics. Smudger 11 may comprise a soft and/or sponge-like material such as foam, rubber, silicone, or other materials. Smudger 11 may be located at other parts of handle 12 or of eyeliner application aid 10 generally.

Handle 12 may comprise end details 15 on one or both handle ends 13A, 13B. End details 15 may, for example, comprise rounded caps, such as hemispherical or ovoid caps. Such caps may reduce or avoid sharp edges (or otherwise taper the shape) of handle 12. Alternatively, or in addition, edge details 15 may comprise cylinders, prisms, knobs, cones and/or other shapes and designs.

In at least one embodiment, one or both of handle end 13A and handle end 13B comprise an end detail 15. An optional end detail 15 is shown in dashed lines in FIG. 1C. End detail 15 may, for example, comprise a cylinder with a radial axis in alignment with the radial axis of handle 12; with reference to FIG. 3, both of these axes may be aligned with axis $A_E$. In such an embodiment, the end detail may have a diameter less than the diameter of handle 12. For example, in at least one embodiment wherein handle 12 has a diameter of approximately 9.5 mm (approximately 0.375 inches), the end details have a diameter of approximately 8 mm (approximately 0.313 inches). In such an example embodiment, end details may have a length of approximately 6.4 mm (approximately 0.25 inches) each and handle 12 may have a length of approximately 88.9 mm (approximately 3.5 inches), inclusive of the end details.

FIG. 3 shows a side elevation view of shaped member 30 of the eyeliner application aid 10 of FIG. 1. In at least one embodiment, shaped member 30 comprises a stainless steel rod bent into a shape described above and partially inserted into handle 12. In other embodiments, shaped member 30 may be molded, extruded, assembled, pressed, and/or otherwise manufactured.

Shaped member 30 comprises an extender 14, as described above. In the illustrated embodiment, as seen in FIG. 3, extender 14 connects to a first junction 32 of shaped member 30. First junction 32 connects to first nose bridge portion 34. First junction 32 may comprise a sharp corner between extender 14 and first nose bridge portion 34; in the illustrated embodiment, however, first junction 32 is curved and possesses a uniform radius of curvature. Although the radius of curvature of first junction 32 may comprise any value, in some embodiments the radius of curvature of first junction 32 is in a range from approximately 2.5 mm (approximately 0.1 inches) to approximately 12.7 mm (approximately 0.5 inches). Radii in such a range may avoid causing first junction 32 to be overly sharp and yet not so large as to make shaped member 30 unwieldy when positioned around at least some persons' noses. In at least one embodiment, first junction 32 has a radius of curvature of 6.4 mm (approximately 0.25 inches).

As seen in FIG. 3, first nose bridge portion 34 extends from first junction 32 to second junction 36 of shaped member 30. As discussed above, in the context of nose bridge 16, first nose bridge portion 34 may comprise any one of a variety of configurations, including curved and/or straight configurations. In the illustrated embodiment, first nose bridge portion 34 is straight and extends at an angle θ to axis $A_E$. In some embodiments, angle θ generally corresponds to an angle at which a nose is sloped relative to $A_E$ while eyeliner application aid 10 is in use. In some embodiments, angle θ may be a value in the range of 20 degrees to 70 degrees. In the illustrated embodiment, first nose bridge portion 34 extends at an angle θ of approximately 46 degrees to axis $A_E$.

In the illustrated embodiment, first nose bridge portion 34 connects to second junction 36 at an end opposite to first junction 32. As with first junction 32, second junction 36 may comprise a sharp angle, curved corner, and/or other configurations. In at least one embodiment, as shown in FIG. 3, second junction 36 is curved and has a radius of curvature $R_N$ of approximately 6.4 mm (approximately 0.25 inches). In the illustrated embodiment, first junction 32 and third junction 40 also have radii of curvature; these are not depicted in FIG. 3.

Second junction 36 connects to second nose bridge portion 38. As with first nose bridge portion 34, second nose bridge portion 38 may comprise any one of a variety of configurations. Although the shape of second nose bridge portion 38 may be different from the shape of first nose bridge portion 34, in some embodiments second nose bridge portion 38 mirrors the shape of first nose bridge portion 34. For example, in the illustrated embodiment the angle between first nose bridge portion 34 and second nose bridge portion 38 is approximately 90 degrees and second nose bridge portion 38 otherwise mirrors the configuration of first nose bridge portion 34 (i.e. second nose bridge portion 38 is generally straight, the same length as first nose bridge portion 34, and also at an angle θ to axis $A_E$).

Second nose bridge portion 38 connects to third junction 40. Third junction 40 connects to eyeliner guide 18. As with first junction 32 and second junction 36, third junction 40 may comprise a sharp angle, curved corner, and/or other configurations. In at least one embodiment where the junctions are curved, third junction 40 may comprise a smaller radius of curvature than those of first junction 32 and/or second junction 36; for example, second junction 36 may have a radius of curvature of approximately 3.2 mm (approximately 0.125 inches).

Figure 4A:
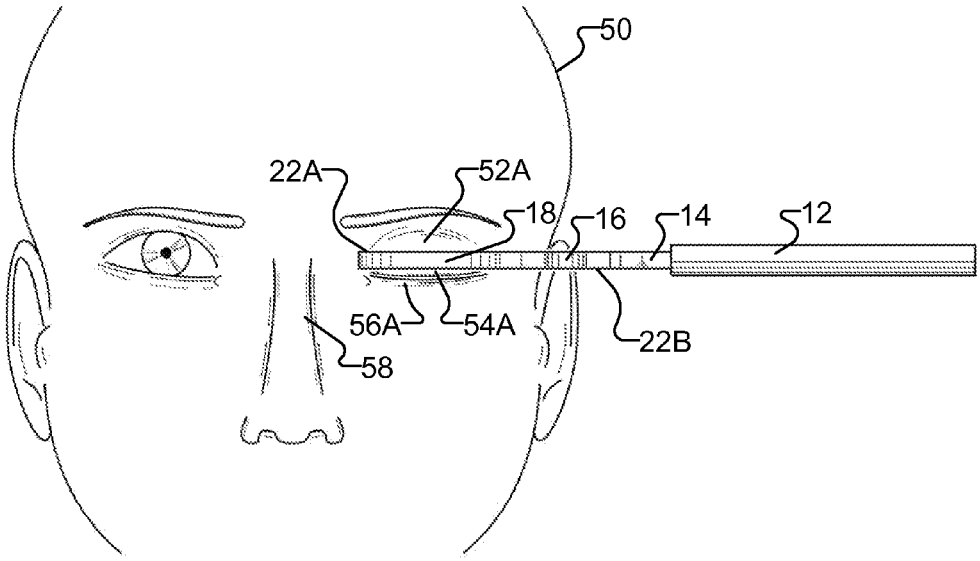
FIG. 4A is a front perspective view of the FIG. 1A-D eyeliner aid being applied to one eye according to an example method of using the eyeliner aid.
Figure 4B:
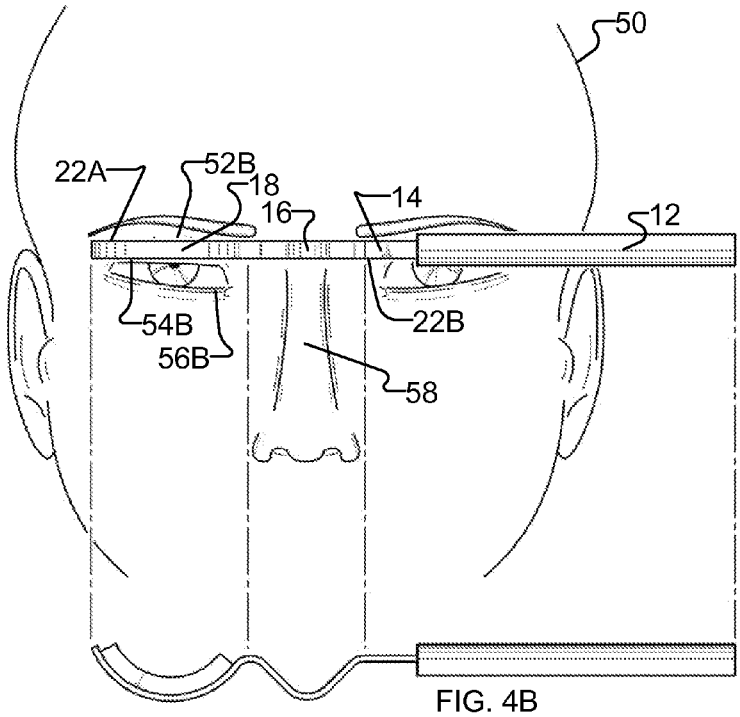
FIG. 4B is a front perspective view of the FIG. 1A-D eyeliner aid being applied to the other eye according to an example method of using the eyeliner aid.

FIG. 4A shows an example eyeliner application aid 10 being applied to a person's eyelid 52. FIG. 4B shows an example eyeliner application aid 10 being applied against a person's eyelid while the person's nose 56 is received in nose bridge 16. In either of these examples, cushion 20 is pressed against the eyelid just above eyeline 54. A user may draw an applicator along a side of eyeliner guide 18 adjacent to eyeline 54 and thereby apply eyeliner to eyeline 54 and avoid applying eyeliner to other areas.

The user may use eyeliner application aid 10 to apply eyeliner to herself (or himself), and/or the user may use eyeliner application aid 10 to apply eyeliner to another person. For example, the user may be a professional makeup artist who is applying eyeliner to a client. The artist may position herself or himself relative to the client however the artist considers appropriate. For example, the artist may be positioned in front of the client and face the client. Alternatively, or in addition, the artist may stand behind the client and view the client's face in a mirror. In the following examples, the scenario where a user applies makeup to her own eyelines will be considered; scenarios where users apply makeup to other persons' eyelines are analogous.

As depicted in FIGS. 4A and 4B (collectively, FIG. 4), some embodiments of eyeliner application aid 10 allow a user to hold handle 12 on either side of nose 58 and thereby select which hand is free to apply eyeliner to upper eyelines 54 and/or lower eyelines 56 without having to contort and/or place one or both hands in an unnatural and/or uncomfortable position. Accordingly, eyeliner application aid 10 may be held in one hand and positioned over either eye in turn while the other hand (e.g. the dominant hand) applies eyeliner to the face.

For example, a user may hold handle 12 in her left hand on the left side of her face; she may position eyeliner application 10 such that cushion 20 is pressed against her left eyelid 52A just above her left upper eyeline 54A, as shown in FIG. 4A. The user may then apply eyeliner by drawing an eyeliner applicator (such as a liquid eyeliner brush or kohl eyeliner pencil) along side 22B. By holding handle 12 steady, shaped member 30 (and, in particular, side 22B of eyeliner guide 18) acts as a guide for the eyeliner applicator, preventing the eyeliner from straying from a smooth line across left upper eyeline 54A.

Alternatively, or in addition, the user may position eyeliner application 10 such that cushion 20 is pressed against her left lower eyeline 56A, just below her left upper eyeline 54A while left eyelid 52A is closed. The user may then apply eyeliner by drawing an eyeliner applicator along side 22A. The user may position eyeliner application 10 such that the user's eyelashes are held between cushion 20 and the user's face, thereby avoiding interference from the eyelashes while applying eyeliner.

In the illustrated use, the user's left eyelid 52A is closed. In other uses, the user may at least partially open her left eyelid 52A; for example, the user may keep her left eyelid 52A half-open such that left upper eyeline 54A runs substantially horizontally across the center of the eye.

Continuing the above example, the user may then move eyeliner application aid 10 down such that cushion 20 is located just below left lower eyeline 56A. The user may then draw an eyeliner applicator along side 22A of eyeliner guide 18, thereby applying eyeliner neatly to left lower eyeline 56A. While applying eyeliner to left lower eyeline 56A in the manner described, the user may close, partially open, and/or fully open her left eyelid 52A.

Alternatively, or in addition, the user may position eyeliner application 10 such that cushion 20 is pressed against her left upper eyeline 54A, just above her left lower eyeline 56A while left eyelid 52A is closed. The user may then apply eyeliner by drawing an eyeliner applicator along side 22B.

The user may then choose to move eyeliner application aid 10 across her face such that cushion 20 is pressed against her right eyelid 52B just above her right upper eyeline 54B, as shown in FIG. 4B. The user may hold eyeliner application aid 10 in either hand; in the illustrated use of eyeliner application aid 10, she may continue to hold handle 12 in her left hand and position nose bridge 16 above her nose 58, thereby receiving at least a portion of nose 58 with nose bridge 16. In addition to allowing the user to place eyeliner application aid 10 across her face without being obstructed by nose 58, the user may use nose 58 as a stabilizing support, assisting the user in holding eyeliner application aid 10 in place. The user may the apply eyeliner to right upper eyeline 54B by drawing an eyeliner applicator along side 22B of eyeliner guide 18.

The user may then move eyeliner application aid 10 down such that cushion 20 is located just below right lower eyeline 56B. The user may then draw an eyeliner applicator along side 22A of eyeliner guide 18, thereby applying eyeliner neatly to right lower eyeline 56B.

If the user is ambidextrous, and/or if the user prefers to hold eyeliner application aid 10 in different hands at different times, she may choose to switch hands when positioning eyeliner application aid 10 on the other eye. For example, instead of continuing to hold handle 12 in her left hand when applying eyeliner to the right eye as described above, she may hold handle 12 in her right hand so that the handle extends away from the right side of the face while applying eyeliner to the right eye with the left hand. In some embodiments, use in this manner will result in nose 58 not being received by nose bridge 16.

The above example describes a particular method by which eyeliner may be applied with the aid of eyeliner application aid 10. In other methods, the user may apply eyeliner only to upper eyelines 54, only to lower eyelines 56, only to the eyelines of one eye, only to a single eyeline, etc. The user may hold handle 12 in different hands at different times. For example, the user may hold handle 12 in her right hand while applying eyeliner to the eyelines of her right eye, and hold handle 12 in her left hand while applying eyeliner to the eyelines of her left eye, thereby avoiding the need to insert nose 58 into nose bridge 16. Alternatively, or in addition, the user may hold handle 12 in her right hand while applying eyeliner to the eyelines of her left eye, and hold handle 12 in her right hand while applying eyeliner to the eyelines of her left eye; the user may insert nose 58 into nose bridge 16 to facilitate such positions.

In embodiments wherein eyeliner application aid 10 comprises a wing 19, a user's choice of holding positions may be restricted, but in exchange they may obtain the ability to accurately and easily apply "wing" effects using the present invention.

In embodiments wherein eyeliner application aid 10 comprises a smudger 11, a user may, after applying eyeliner to eyeline 54, press smudger 11 against the applied eyeliner and obtain a smudged or "smoky" effect. This does not defeat the purpose of eyeliner application aid 10, as an initially-precise application of eyeliner may improve and/or simplify the creation of such an effect.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. An eyeliner application aid for guiding the application of eyeliner around a person's eye, comprising:

a handle extending in an extension direction;

a shaped member connected to the handle, extending generally in the extension direction and comprising:

a guide portion protruding in a protrusion direction, the protrusion direction orthogonal to the extension direction; and a nose bridge portion between the guide portion and the handle, the nose bridge portion adapted to receive at least a portion of a nose bridge of the person and protruding in the protrusion direction;

wherein:

the guide portion is adapted to receive at least a portion of a first eyelid of the person while the handle extends in a first direction, the received portion of the first eyelid proximate to substantially all of a first eyeline of the first eyelid; and the guide portion is adapted to receive at least a portion of a second eyelid of the person while the handle extends in substantially the first direction, the received portion of the second eyelid proximate to substantially all of a second eyeline of the second eyelid wherein the shaped member comprises an extension portion, the extension portion extending in the extension direction; the extension portion connecting to the handle at a first end of the extension portion; and the extension portion connecting to the nose bridge portion at a second end of the nose bridge portion.

2. An eyeliner application aid according to claim 1 wherein the guide portion and the nose bridge portion are spaced apart in the extension direction at a distance corresponding to a distance between the nose bridge and at least one of the first and second eyelids of the person.

3. An eyeliner application aid according to claim 2 wherein a distance between an apex of the guide portion and an apex of the nose bridge portion in the extension direction is between 25 millimeters and 51 millimeters.

4. An eyeliner application aid according to claim 1 comprising a cushion abutting and connected to a concave surface of the guide portion, the cushion comprising a compressible material.

5. An eyeliner application aid according to claim 1 wherein the shaped member comprises a wing portion, the wing portion connected to the guide portion, extending at least partially in the extension direction, and adapted to abut a portion of the person's face proximate to at least one of the first and second eyelids.

6. An eyeliner application aid according to claim 1 comprising a smudger connected to the handle and comprising a compressible material adapted to smudge a cosmetic on the person's skin.

7. An eyeliner application aid according to claim 1 wherein an end of the handle distal to the shaped member is tapered.

8. An eyeliner application aid according to claim 1 wherein the handle comprises a cylinder with a diameter of at least 5 millimeters and no more than 51 millimeters along a substantial length of the handle; and the handle comprises a length of at least 50 millimeters and no more than 152 millimeters.

9. An eyeliner application aid according to claim 1 wherein the handle comprises a slot and the shaped member is insertable into the slot.

10. An eyeliner application aid according to claim 1 wherein the extension portion comprises a length of at least 5 millimeters and no more than 76 millimeters.

11. An eyeliner application aid according to claim 1 wherein at least a portion of the handle extends along an extension axis; the extension portion extends along the extension axis; and an apex of the nose bridge portion is offset from the extension axis by a distance of between 12 millimeters and 51 millimeters.

12. An eyeliner application aid according to claim 1 wherein the guide portion is shaped in an arc with a radius of curvature of at least 15 millimeters and no more than 31 millimeters.

13. An eyeliner application aid according to claim 1 wherein the shaped member has a cross-section in a plane orthogonal to the extension direction and the cross-section is generally rectangular in shape.

14. A method of applying eyeliner to a face of a person, the method comprising:

placing a guide portion of an eyeliner application aid proximate to substantially all of a first eyeline of the person so that a handle of the eyeliner application aid extends in a first direction;

receiving with a nose bridge portion of the eyeliner application aid at least a portion of a nose of the person;

applying cosmetic material to the first eyeline by drawing an eyeliner applicator along at least a portion of a side of the guide portion;

placing the guide portion of the eyeliner application aid proximate to substantially all of a second eyeline of the person so that the handle of the eyeliner application aid extends in substantially the first direction; and applying cosmetic material to the second eyeline by drawing the eyeliner applicator along at least a portion of the side of the guide portion.

15. A method according to claim 14 wherein placing the guide portion of the eyeliner application aid proximate to the first eyeline comprises receiving with the guide portion at least a portion of an eyelid of the person proximate to an upper eyeline of the person.

16. A method according to claim 14 wherein placing the guide portion of the eyeliner application aid proximate to the first eyeline comprises receiving with the guide portion at least a portion of the face of the person proximate to a lower eyeline of the person.

17. A method according to claim 14 comprising:

gripping a handle of the eyeliner application aid with a hand while applying cosmetic material to the first eyeline, wherein the first eyeline is proximate to a first eye of the person;

placing the guide portion of the eyeliner application aid proximate to a second eyeline of the person, the second eyeline proximate to a second eye of the person; and gripping the handle of the eyeliner application aid with the hand and applying cosmetic material to the second eyeline by drawing the eyeliner applicator along at least a portion of a side of the guide portion.

18. A method of applying eyeliner to a face of a person, the method comprising:

placing a guide portion of an eyeliner application aid proximate to a first eyeline of the person;

receiving with a nose bridge portion of the eyeliner application aid at least a portion of a nose of the person;

applying cosmetic material to the first eyeline by drawing an eyeliner applicator along at least a portion of a side of the guide portion;

placing a wing portion of the eyeliner application aid proximate to an eye of the person; and applying a cosmetic material to at least a portion of the face of the person proximate to the wing portion by drawing the eyeliner applicator along at least a portion of a side of the wing portion.

* * * * *